US008704450B2

(12) United States Patent
Chen et al.

(10) Patent No.: US 8,704,450 B2
(45) Date of Patent: Apr. 22, 2014

(54) FLASH LED CONTROLLER

(75) Inventors: Wayne Chen, Plano, TX (US); Jonathan Knight, Tokyo (JP); Ross Teggatz, McKinney, TX (US); Brett Smith, McKinney, TX (US); Trichy Narasimhan, Richardson, TX (US)

(73) Assignee: Triune IP, LLC, Richardson, TX (US)

( * ) Notice: Subject to any disclaimer, the term of this patent is extended or adjusted under 35 U.S.C. 154(b) by 275 days.

(21) Appl. No.: 13/037,353

(22) Filed: Feb. 28, 2011

(65) Prior Publication Data

US 2012/0104962 A1 May 3, 2012

Related U.S. Application Data

(60) Provisional application No. 61/308,830, filed on Feb. 26, 2010.

(51) Int. Cl.
*H05B 37/00* (2006.01)

(52) U.S. Cl.
USPC ..... 315/200 A; 315/228; 315/307

(58) Field of Classification Search
USPC ..... 315/200 A, 241 P, 241 S, 291, 294, 297, 315/307, 227 R, 228, 312; 396/205
See application file for complete search history.

(56) References Cited

U.S. PATENT DOCUMENTS

| | | | | |
|---|---|---|---|---|
| 6,538,394 | B2 * | 3/2003 | Volk et al. | 315/291 |
| 7,250,810 | B1 * | 7/2007 | Tsen | 327/536 |
| 7,991,282 | B1 * | 8/2011 | McIntyre et al. | 396/205 |
| 8,077,139 | B2 * | 12/2011 | Chang et al. | 345/102 |
| 2009/0108775 | A1 * | 4/2009 | Sandner et al. | 315/297 |
| 2009/0121653 | A1 * | 5/2009 | Chida | 315/307 |
| 2010/0327928 | A1 * | 12/2010 | Li et al. | 327/170 |

* cited by examiner

*Primary Examiner* — Tung X Le
(74) *Attorney, Agent, or Firm* — Hovey Williams LLP

(57) ABSTRACT

The invention provides integrated power supplies, circuit drivers, and control methods for relatively high-current drivers, usable with common battery power sources. Preferred embodiments include one or more high series resistance super-capacitors electrically connected with a power. A low resistance driver circuit regulates power supplied from the super-capacitors to the load.

3 Claims, 4 Drawing Sheets

FLASH LED CONTROLLER

PRIORITY ENTITLEMENT

This application is entitled to priority based on Provisional Patent Application Ser. No. 61/308,830 filed on Feb. 26, 2010, which is incorporated herein for all purposes by this reference. This application and the Provisional patent application have at least one common inventor.

TECHNICAL FIELD

The invention relates to electronics and microelectronic circuitry. In particular, the invention is directed to integrated power supplies, circuit drivers, and control methods.

BACKGROUND OF THE INVENTION

It is sometimes desirable to use components with high current requirements in portable electronic apparatus. Problems arise, however with driving high-current devices using common batteries. On the one hand, battery voltage must be sufficient to drive the high-current devices. On the other hand, the current requirements may be so high that there is a risk of damaging the batteries. An example is the use of powerful LEDs as flash elements in small cameras. Overall, this is a desirable implementation in order to reduce battery drain, reduce cost, and minimize device size compared to xenon flash systems. Commonly available Lithium Ion (Li-Ion) batteries often used in such applications are limited in their voltage capacities, however, and are often incapable of withstanding the high currents required for driving the LEDs.

Due to these and other problems and potential problems, improved approaches for providing relatively high-current drivers for use with common battery power sources would be useful and advantageous contributions to the arts.

SUMMARY OF THE INVENTION

In carrying out the principles of the present invention, in accordance with preferred embodiments, the invention provides advances in the arts with novel methods and apparatus directed to useful for power supplies, converters, and drivers.

According to one aspect of the invention, a preferred embodiment of a circuit includes at least one high series resistance super-capacitor coupled for driving a load. The super-capacitors(s) are electrically connected with a power supply for charging. A low resistance driver circuit is connected for regulating power supplied from the super-capacitors to the load based on output current detection.

According to another aspect of the invention, in a presently preferred embodiment, a circuit includes high series resistance super-capacitors charged by a battery power source. The super-capacitors are coupled for driving a load consisting of one or more LEDs. The voltage requirements of the LEDs are such that driving them directly with the battery power source would be impractical. A low resistance driver circuit is connected for regulating power supplied from the super-capacitors to the load based on load current.

According to still another aspect of the invention, in examples of preferred embodiments, the above-described circuits may be implemented using parallel and/or series combinations of super-capacitors, driver circuits, and load components.

According to another aspect of the invention, in a preferred embodiment, high series resistance super-capacitors are coupled for driving a load. A low resistance driver circuit connected for regulating power from the super-capacitors to the load includes a PWM switch control.

According to another aspect of the invention, preferred embodiments encompass methods for using high series resistance super-capacitors to drive loads including steps for charging the super-capacitors and subsequently regulating their output to the load by using feedback sensed at the load.

According to additional aspects of the invention, preferred methods of the invention include steps for dynamically compensating for ambient conditions, load component mismatch, or other variations in output requirements.

The invention has advantages including but not limited to one or more of the following, energy efficiency, area efficiency, and cost-effectiveness in providing high drive currents in systems using relatively low voltage batteries. These and other advantageous features and benefits of the present invention can be understood by one of skilled in the arts upon careful consideration of the detailed description of representative embodiments of the invention in connection with the accompanying drawings.

BRIEF DESCRIPTION OF THE DRAWINGS

The present invention will be more clearly understood from consideration of the following detailed description and drawings in which.

Figure 1:
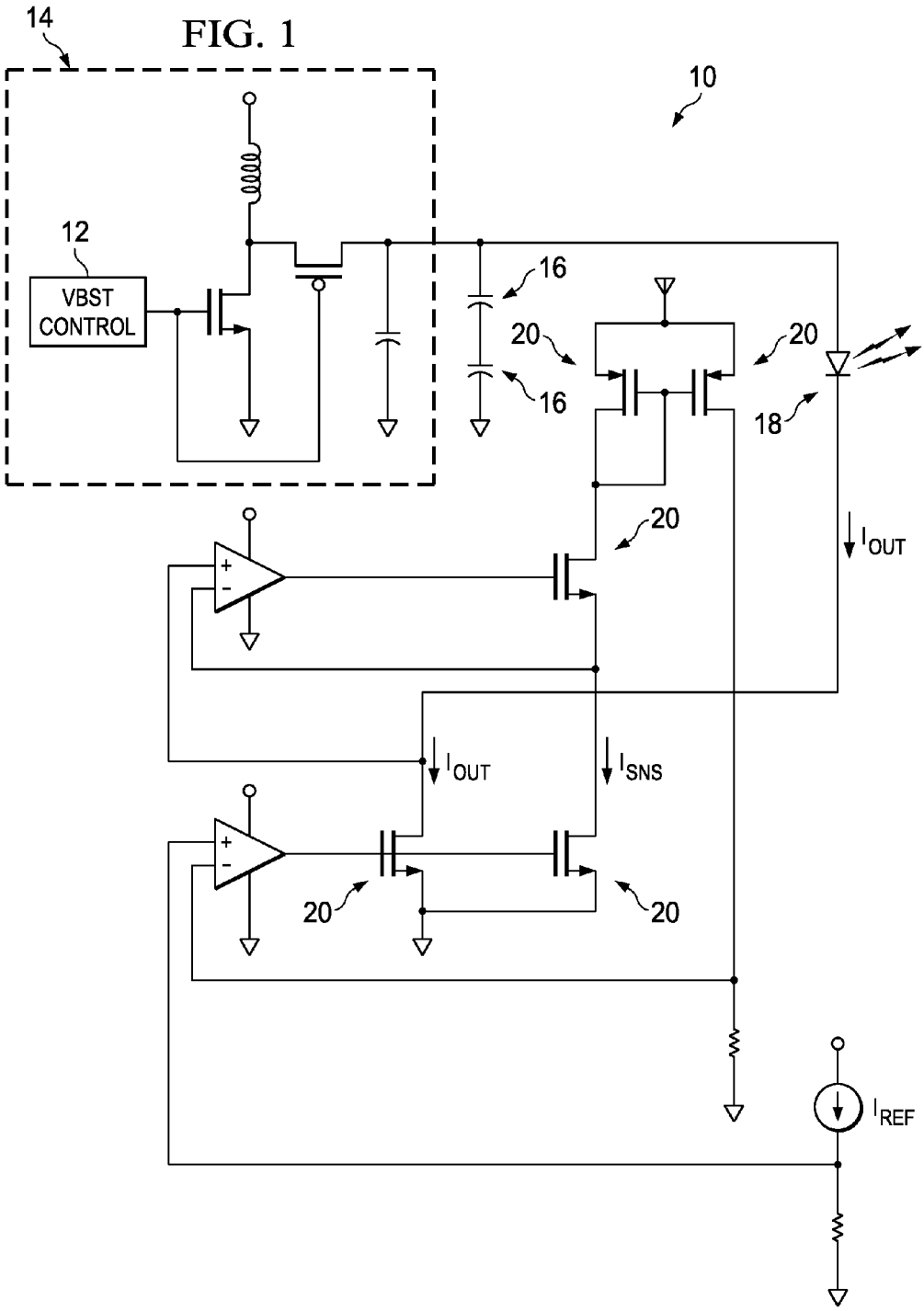
FIG. 1 is a simplified schematic circuit diagram illustrating an example of preferred embodiments of circuits, systems, and methods according to the invention.

References in the detailed description correspond to like references in the various drawings unless otherwise noted. Descriptive and directional terms used in the written description such as right, left, back, top, bottom, upper, side, et cetera, refer to the drawings themselves as laid out on the paper and not to physical limitations of the invention unless specifically noted. The drawings are not to scale, and some features of embodiments shown and discussed are simplified or amplified for illustrating principles and features, as well as anticipated and unanticipated advantages of the invention.

DESCRIPTION OF PREFERRED EMBODIMENTS

Addressing the challenges of driving high-current devices in apparatus in which power availability, size and cost are important factors, the inventors have developed an approach using super-capacitors. Generally, the super-capacitors are charged using available battery power and are then used to drive the high-current devices at suitable intervals. Techniques and associated circuitry have been developed for maintaining charge on the super-capacitors and for controlling the supply of current to the driven devices. In an example of a preferred embodiment, a fully-integrated power supply and multi-channel driver for LED applications is configured to charge super-capacitors using a DC/DC synchronous switching boost regulator with fully integrated power switches, internal compensation, and full fault protection. A very low resistance driver is used to energize the driven load, in this example LEDs, with minimal loss of super-capacitor rail voltage headroom. The charging of the super-capacitors is preferably accomplished operating in a regulation mode by providing current feedback to the boost regulator. Preferably, operating in a standby mode the circuitry draws very little quiescent current and periodically refreshes the charge on the super-capacitors as needed.

The study, design, experimentation, and refinement of the techniques and circuitry using super-capacitors in the manner described has led to the development of useful advances in the art. It has been determined that with sufficient capacitor capacity, a minimal voltage drop is incurred as a result of a brief current pulse needed for a single high-current load event. As long as the capacitor can be replenished by a boost regulator operating from the battery, there is ample voltage and current available for each event without putting excessive strain on the battery. In the presently preferred exemplary embodiment of a flash LED controller, a current pulse of approximately 30-50 ms is used. Super-capacitors having suitable characteristics for such applications also tend to have relatively high Equivalent Series Resistance (ESR). This is a potential problem given conventional approaches to flash LED driver design in that the voltage drop across the ESR of the capacitor(s) may be excessive, leading to insufficient current availability for driving the flash LED. As an example, two 2.7V capacitors in series can be safely charged to 5.4V. With a combined ESR of 250 mΩ and a load current of 4 A, the voltage drop across the ESR is 1V. With the forward voltage drop of a typical LED at about 4V, only 400 mV of headroom remains for the driver circuit. Additionally, some discharge of the capacitor must also be expected during the flash event. This is generally on the order of about 100-200 mV. This problem has been addressed by developing ways to drive the load providing the required current as efficiently as practical taking into account changes in the current level as the capacitor is discharged, differing current requirements at the load(s), e.g., due to variations in the characteristics of individual LEDs, and temperature-dependent variations in forward voltage drop of the load(s).

As shown in FIG. 1, in an example of a preferred embodiment of the invention a circuit 10 is shown in which a battery 12 is coupled to a boost regulator 14 for charging two super-capacitors 16. The super-capacitors 16 are coupled in series with a load device, in this example an LED 18, having fairly high voltage and current requirements relative to the battery 12. The super-capacitors 16 are selected for their ability to provide a relatively high current pulse at the LED 18 without overtaxing the battery 12. Suitable super-capacitors generally have a maximum working voltage within the range of approximately 2.5-2.7V. Thus, in this example assuming an LED requiring 4V, it is preferred to place at least two super-capacitors in series in order to provide enough supply voltage to be able to drive a single LED. In principle, any number of super-capacitors may be placed in series, but on the other hand, it is desirable to minimize the number of large capacitors that must be used in a system. It is characteristic for suitable super-capacitors to have a high Equivalent Series Resistance (ESR). In order to make the most of available voltage from the high-ESR super-capacitors, it is preferred to drive the LED from the capacitors using a low-resistance switching mechanism. In order to accomplish this, however, it has been discovered to be necessary to use some means of limiting the current to the LED when its forward voltage drop is anything lower than its maximum predicted value. In this example, a current mirror configuration is shown in which the output current $I_{OUT}$ is sensed and compared to a reference current $I_{REF}$. The comparison provides the basis for switching the current to the load, LED 18 in this example. This approach yields an accurate and cost- and size-efficient approach to driving high-current components, such as flash LEDs, using high-ESR super capacitors. Since the voltage drop across the ESR is considerably larger than the variation of the forward voltage of the LEDs, the ratio of peak to average current can be held to approximately 1.5:1 or 2:1, which is advantageous in terms of long-term reliability and, in LED systems, for consistency in color temperature. The approach for ensuring sufficient drive current availability while using high ESR super-capacitors is to directly drive the load with very low resistance switch FETs 20. The boost voltage is preferably set to be just sufficient to drive the load to maximum current assuming the upper limit of the load's forward voltage. When load component mismatch, temperature, or other conditions are such that the forward voltage is less than this upper limit, the driver automatically responds accordingly, driving the FETs at a level which results in the desired average current. In multiple channel implementations, the current level in each channel is preferably controlled individually.

Figure 2:
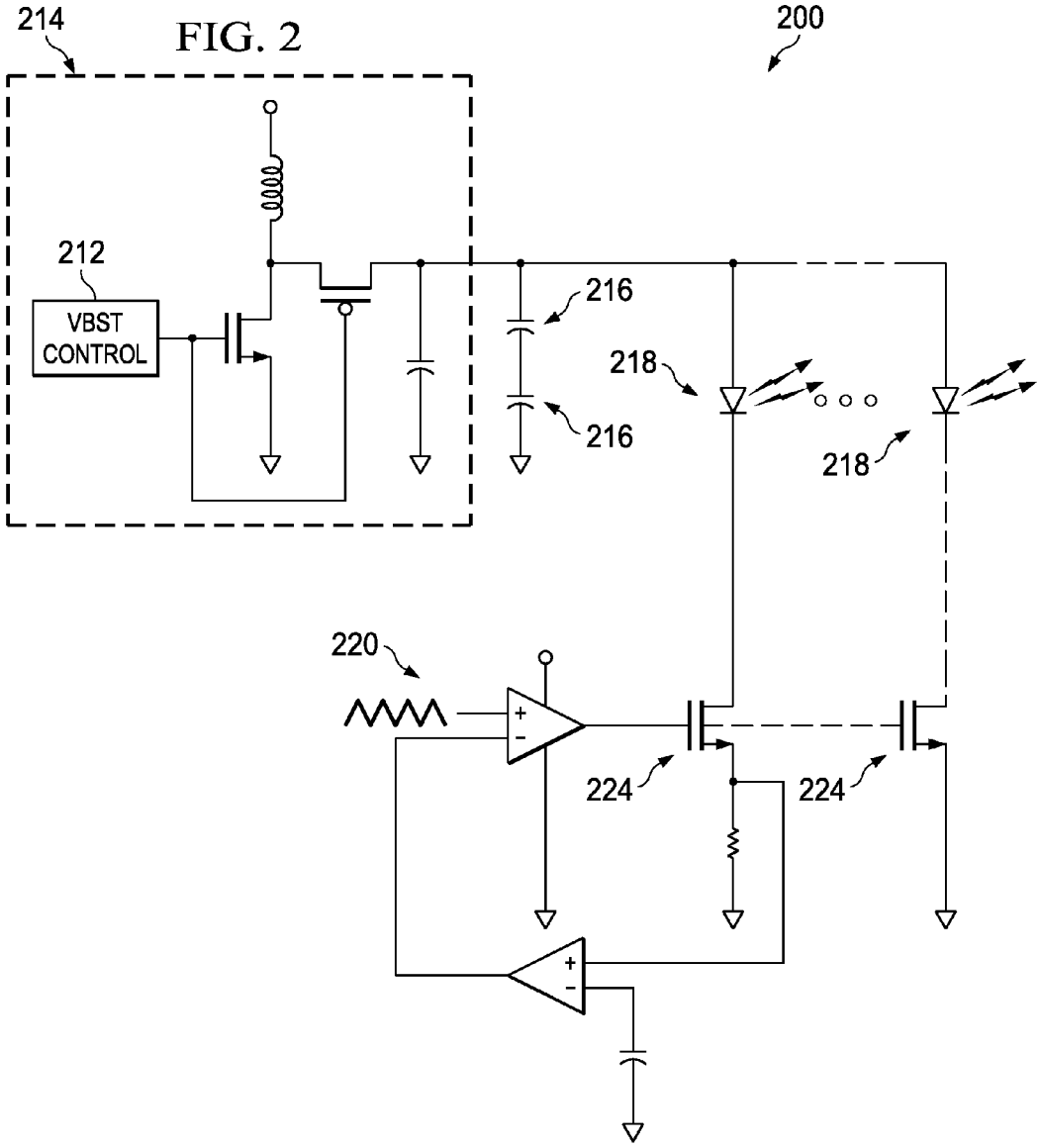
FIG. 2 is a simplified schematic circuit diagram illustrating an example of alternative preferred embodiments of circuits, systems, and methods according to the invention using PWM for regulating output.

Another example of a preferred implementation for using high ESR super-capacitors for driving a load is to pulse width modulate (PWM) the switch so that the average current through the load is set to a desired value independent of the variation in peak current caused by variations in the forward voltage drop of the load. It is desirable to choose a switching frequency which is above the audible band, but still low enough to favor system efficiency and effective regulation of the average load current during an operating cycle. In the LED example shown and described, the period under load is on the order of approximately 30-50 ms. Thus, the period of a 20 kHz PWM frequency being 50 μS, a pulse count of roughly 1000 can easily be achieved for one flash cycle. This has been found to be ample to ensure accurate regulation of the flash current. Additionally, the pulse period of 50 μS is sufficient to facilitate accurate measurement of the peak current flowing through the drive transistor using analog IC design techniques familiar to those skilled in the arts. FIG. 2 depicts an example of a preferred embodiment of a circuit implementation of a current-controlled PWM LED driver circuit 200. The battery 212 is coupled to a boost regulator 214 for charging two super-capacitors 216 in the manner described previously. Coupled in series with a load 218, the super-capacitors 216 drive the load 218 under the control of a low-voltage, current-controlled PWM switch 220. The monitored DC output level 224 is used to determine the suitable duty cycle to drive the load 218, in this example, a bank of two or more LEDs placed in parallel.

It should be appreciated that the invention may be practiced in implementing a flash mode, for powering episodic high-intensity events such as a camera flash, and a sustained mode for longer term operation such as for a portable projector or lighting application. In some applications it may be preferable to provide a system switchable between the two modes. In either case, the operational mode is preferably monitored by a watch dog timer for protection. The timer can be switched between a flash mode and a sustained mode. For example, a maximum value selected for a flash mode event may correspond to a maximum duration of 1 second, and 1280 seconds (~21 minutes) for a sustained mode event. When operated to drive a load in a sustained mode, such as for use as a flashlight or to provide a constant light source for recording video, a small section of the large power FET used for flash drive is used to drive the LEDs in sustained mode. In sustained mode, the power FET is operated as a linear current sink, which is preferably user-programmable, the mode being selected by a user via a serial interface.

In a boost regulator adapted for use with the invention, compensation is preferably optimized for using a combination of high-ESR super capacitors and low-ESR ceramic capacitors to supply the large short-term current demands of the load elements and their associated drivers. Preferably, it includes flexibility to be used for a wide range of output voltages, corresponding to a wide range of forward voltages. The regulator is configured to automatically transition between pulse frequency modulation (PFM) and PWM modes to maximize efficiency based on the load demand. The PFM architecture includes power saving circuitry to minimize battery drain, even when the boost regulator is enabled full time. Preferably circuitry is configured for very low current PFM hysteretic power saving features. When the regulator detects very light load conditions, it operates in a low duty cycle condition limited by minimum duty cycle detection in the regulator. This can cause the output voltage to reach an overvoltage condition although this voltage level is very close to the normal output voltage level with less than 3% difference and typically around 1 to 2% higher than the normal operational voltage. When this level of output voltage is detected, a low power mode is entered whereby the device is turned off for power savings. The regulator however maintains the voltage on the output capacitors(s) by monitoring the output voltage and turning on when an undervoltage is detected. This undervoltage level is also typically less than 3% below normal operating voltage and typically 1 to 2% below the normal operational voltage. Upon detection of the undervoltage level, the circuit is turned on to charge the output capacitor(s). In this way, the regulator operates in a low power mode to conserve power hysteritically. This low power mode sustains the charge on the output super-capacitor(s) while conserving power for the large majority of the time when the super-capacitor is charged.

Figure 3:
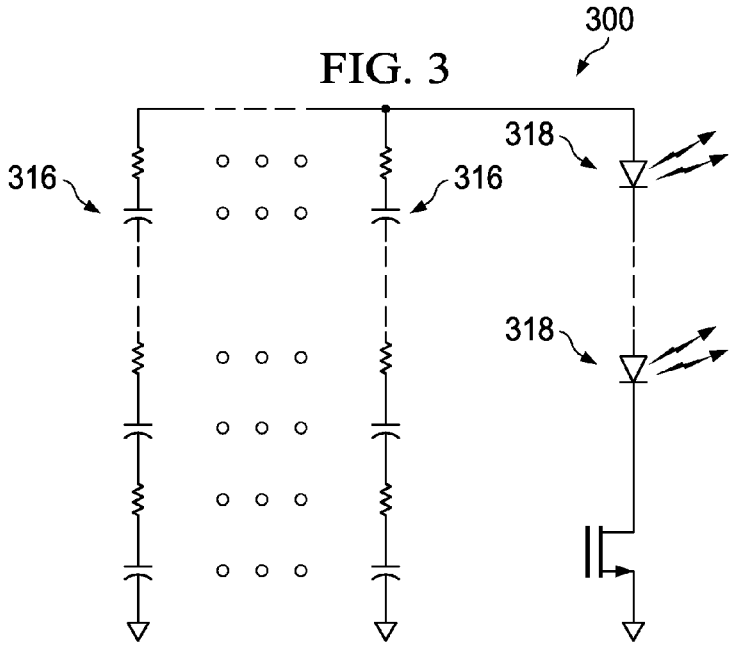
FIG. 3 is a simplified schematic circuit diagram illustrating an example of alternative preferred embodiments of circuits, systems, and methods according to the invention implemented using a combination of super-capacitors.
Figure 4:
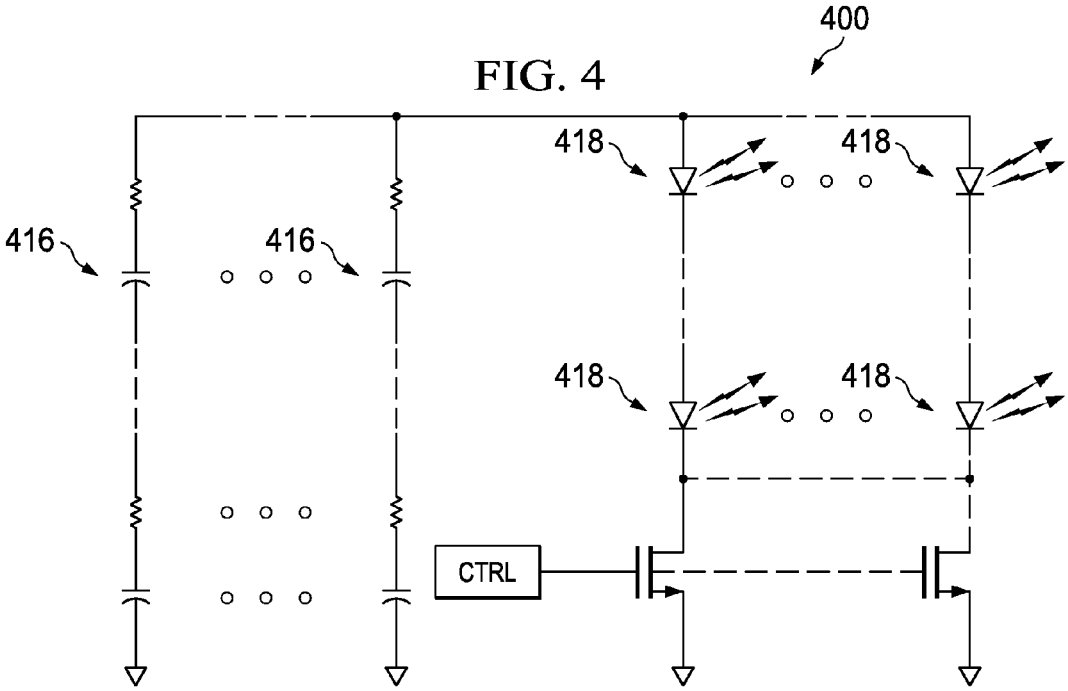
FIG. 4 is a simplified schematic circuit diagram illustrating an example of alternative preferred embodiments of circuits, systems, and methods according to the invention implemented with a combination of load components.
Figure 5:
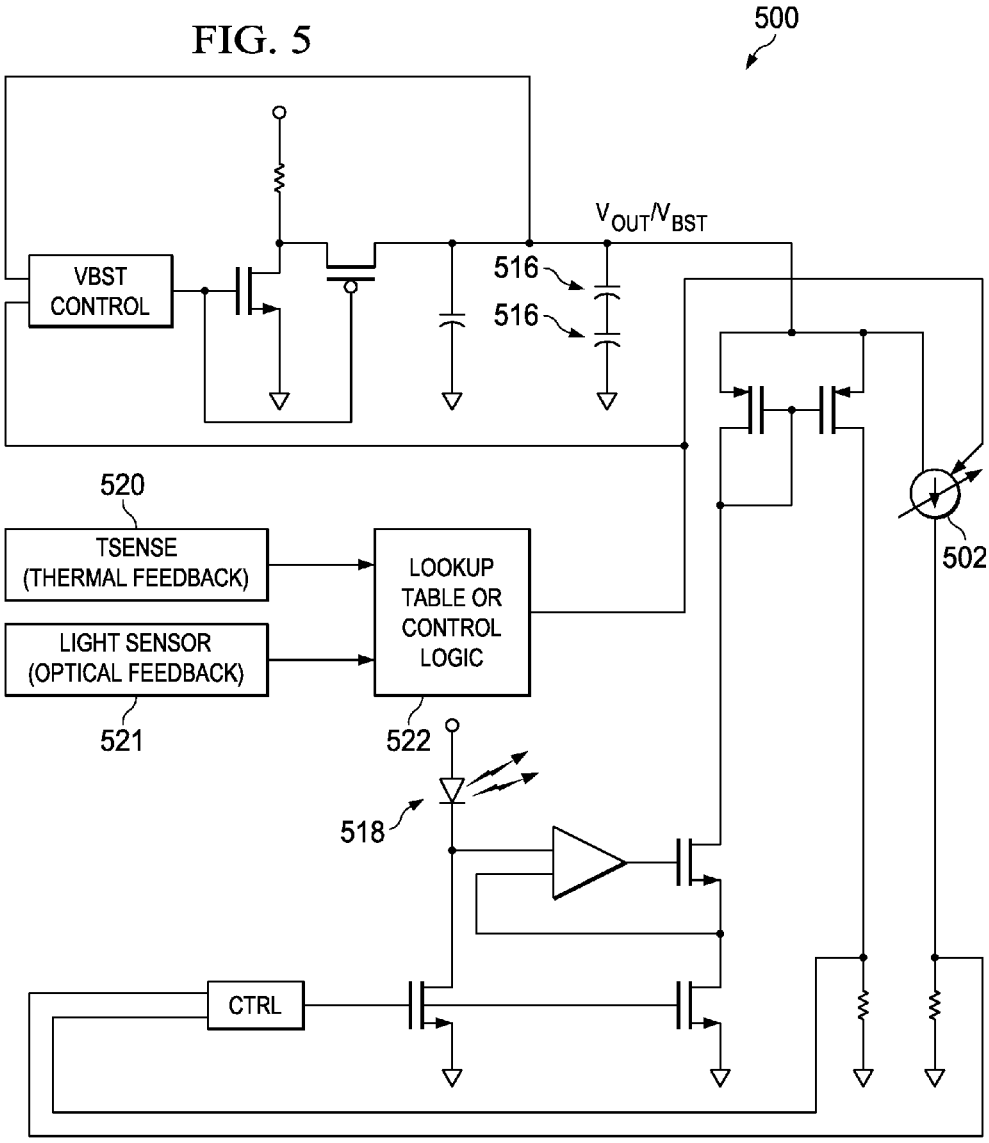
FIG. 5 is a simplified schematic circuit diagram illustrating an example of alternative preferred embodiments of circuits, systems, and methods according to the invention.

Various alternative embodiments may be implemented without departure from the principles of the invention. For example, in order to drive a larger load, such as a number of LEDs in series 318, a larger number of super-capacitors 316 may be placed in series and/or parallel combinations in order to apply the same methods. This configuration 300 is shown in FIG. 3. Additionally, those skilled in the arts should recognize that multiple driver combinations may be used in parallel, wherein multiple loads 418 may be driven from the same super-capacitor or combination of super-capacitors 416, as illustrated in FIG. 4. Differences in forward voltages among individual load components may require different duty cycles for each, resulting in sudden differences in supply voltage, for example, in the event one LED in a load of multiple LEDs is turned off before its neighbor. However, since many switching cycles are used during a flash event, this problem is greatly diminished. Further variations in the circuitry shown and described in the exemplary embodiments may be introduced within the scope of the invention. For example, a sense resistor may be used in series with the driver transistor in order to accurately measure the current at that point. The resistor value is preferably kept very small, since there is only one large current value required. An improvement in system efficiency may also be realized in some applications by implementing direct drain current sensing of the driver transistor. Again, since there is only one large value of average load current required, this can be achieved using IC design techniques known to those skilled in the arts if an integrated driver transistor is employed. In another example of a preferred embodiment illustrated in FIG. 5, in applications where it is desirable for flash LEDs to also be used in a sustained mode, e.g., as a flashlight, instead of using a large driver transistor, a separate supplemental DC current source 502 or sink may also be used to drive the LED 518 without excessive power dissipation. For example, this may be implemented using a linear regulator in combination with a smaller drive transistor to minimize switching loss. Additional monitoring and control features may also be included with the embodiments shown and described, such as a sensor 520 suitable for monitoring ambient temperature or light conditions and adjusting the load current accordingly, and using a look-up table for aging values of LEDs so that the current can be compensated as the system ages.

While the making and using of various exemplary embodiments of the invention are discussed herein, it should be appreciated that the present invention provides inventive concepts which can be embodied in a wide variety of specific contexts. It should be understood that the invention may be practiced with various types of apparatus having load requirements similar to that shown and described with respect to exemplary LED driver applications without altering the principles of the invention. For purposes of clarity, detailed descriptions of functions, components, and systems familiar to those skilled in the applicable arts are not included. The methods and apparatus of the invention provide one or more advantages including but not limited to, providing efficient energy storage and utilization using storage capacitors for driving high current devices. While the invention has been described with reference to certain illustrative embodiments, those described herein are not intended to be construed in a limiting sense. For example, variations or combinations of steps or materials in the embodiments shown and described may be used in particular cases without departure from the invention. Various modifications and combinations of the illustrative embodiments as well as other advantages and embodiments of the invention will be apparent to persons skilled in the arts upon reference to the drawings, description, and claims.

We claim:

1. A circuit comprising:

a first MOSFET transistor including a first drain, a first gate, and a first source;

a second MOSFET transistor including a second drain, a second gate, and a second source;

a third MOSFET transistor including a third drain, a third gate, and a third source;

a fourth MOSFET transistor including a fourth drain, a fourth gate, and a fourth source; and a fifth MOSFET transistor including a fifth drain, a fifth gate, and a fifth source;

wherein the first source and the second source are each connected to a voltage supply, the first gate and the second gate are each connected to the first drain and the fifth drain, the fifth source is connected to the fourth drain, the third source and the fourth source are each connected to ground, and the third drain is connected to a load.

2. The circuit of claim 1, wherein the first and second MOSFET transistors are p-channel type and the third, fourth, and fifth MOSFET transistors are n-channel type.

3. The circuit of claim 1, further comprising:

a first resistor including a first terminal and a second terminal;

a second resistor including a third terminal and a fourth terminal;

a first opamp including a first positive input, a first negative input, and a first output; and a second opamp including a second positive input, a second negative input, and a second output, wherein the second positive input is connected to the third drain, the second negative input is connected to the fifth source, the second output is connected to the fifth gate, the first positive input is connected to the third terminal and a current source, the first negative input is connected to the second drain and the first terminal, the first output is connected to the third gate and the fourth gate, the second terminal is connected to ground, and the fourth terminal is connected to ground.

* * * * *